US010648321B2

(12) United States Patent
Hadi et al.

(10) Patent No.: US 10,648,321 B2
(45) Date of Patent: May 12, 2020

(54) SURFACE CONTROL SYSTEM ADAPTIVE DOWNHOLE WEIGHT ON BIT/TORQUE ON BIT ESTIMATION AND UTILIZATION

(71) Applicant: Nabors Drilling Technologies USA, Inc., Houston, TX (US)

(72) Inventors: Mahmoud Hadi, Richmond, TX (US); Matthew White, Spring, TX (US); Bosko Gajic, Kingwood, TX (US); Austin Groover, Spring, TX (US); Pradeep Annaiyappa, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 320 days.

(21) Appl. No.: 15/478,265

(22) Filed: Apr. 4, 2017

(65) Prior Publication Data

US 2018/0283157 A1 Oct. 4, 2018

(51) Int. Cl.
*E21B 47/06* (2012.01)
*E21B 44/04* (2006.01)

(52) U.S. Cl.
CPC ..... *E21B 47/06* (2013.01); *E21B 44/04* (2013.01)

(58) Field of Classification Search
CPC ..... E21B 44/04; E21B 47/06
See application file for complete search history.

(56) References Cited

U.S. PATENT DOCUMENTS

| | | | | |
|---|---|---|---|---|
| 4,535,972 | A * | 8/1985 | Millheim | E21B 19/08 173/4 |
| 5,852,235 | A | 12/1998 | Pavone et al. | |
| 6,050,348 | A | 4/2000 | Richardson et al. | |
| 2005/0150692 | A1* | 7/2005 | Ballantyne | E21B 7/062 175/61 |
| 2005/0168349 | A1* | 8/2005 | Huang | E21B 47/182 340/854.3 |
| 2009/0090555 | A1* | 4/2009 | Boone | E21B 44/02 175/45 |
| 2011/0144960 | A1* | 6/2011 | Weng | E21B 44/00 703/2 |
| 2013/0032401 | A1* | 2/2013 | Edbury | E21B 7/06 175/24 |

(Continued)

*Primary Examiner* — Omer S Khan
(74) *Attorney, Agent, or Firm* — Haynes and Boone, LLP

(57) ABSTRACT

A drilling rig apparatus is disclosed for improving autodriller control during directional drilling. A BHA determines a relationship between downhole WOB and downhole differential pressure and sends the relationship to a surface controller. The relationships may be sent on a set periodic basis or dynamically in response to the relationships over time differing from each other above a threshold amount. The surface controller estimates downhole WOB by inputting surface differential pressure into a formula implementing the relationship from downhole. The estimated downhole WOB is input into the autodriller for control and is used to estimate MSE. Downhole WOB, either estimated or actual values, may further be used to determine a ratio between downhole WOB and surface-determined WOB values. If the ratio falls below zero in comparison to a prior ratio, then a slack-off rate is adjusted until the ratio reaches zero or a positive value again.

20 Claims, 7 Drawing Sheets

(56) References Cited

U.S. PATENT DOCUMENTS

| | | | | |
|---|---|---|---|---|
| 2014/0196949 | A1* | 7/2014 | Hareland | E21B 44/00 175/27 |
| 2015/0090498 | A1* | 4/2015 | Hareland | E21B 43/26 175/48 |
| 2015/0107899 | A1* | 4/2015 | Fisher, Jr. | E21B 49/003 175/27 |
| 2015/0252664 | A1* | 9/2015 | Astrid | E21B 44/04 700/275 |
| 2018/0328160 | A1* | 11/2018 | Belaskie | E21B 19/008 |

* cited by examiner

SURFACE CONTROL SYSTEM ADAPTIVE DOWNHOLE WEIGHT ON BIT/TORQUE ON BIT ESTIMATION AND UTILIZATION

TECHNICAL FIELD

The present disclosure is directed to systems, devices, and methods for improving autodriller control of a drill string. More specifically, the present disclosure is directed to improving autodriller control using determined relationships between downhole measurement data to estimate weight on bit and torque on bit using surface measurement data.

BACKGROUND OF THE DISCLOSURE

Subterranean "sliding" drilling operations typically involve rotating a drill bit on a downhole motor at a remote end of a drill pipe string. Drilling fluid forced through the drill pipe rotates the motor and bit. The assembly is directed or "steered" from a vertical drill path in any number of directions, allowing the operator to guide the wellbore to desired underground locations. For example, to recover an underground hydrocarbon deposit, the operator may drill a vertical well to a point above the reservoir and then steer the wellbore to drill a deflected or "directional" well that penetrates the deposit. The well may pass through the deposit at a non-vertical angle, e.g. horizontally. Friction between the drill string and the bore generally increases as a function of the horizontal component of the bore, and slows drilling by reducing the force that pushes the bit into new formations.

Current approaches measure weight on bit using a hookload signal at the surface during drilling operations. For drilling of vertical wells, assuming no buckling is occurring along the drill pipe downhole, the calculation of the downhole weight on bit is a straight forward one. If, however, the well is a directional well, such as during "sliding" drilling operations, then this approach to calculating weight on bit is not reliable. Once the drill bit kicks off the curve, the weight on bit displayed to the driller in current approaches is not the true weight on bit. Instead, in directional sections the driller depends on mud motor differential pressure to estimate the weight on bit. A challenge arises, however, because the mud motor differential pressure does not identify when the bit has exceeded its physical load limit.

Several additional challenges exist with the current uses of mud motor differential pressure. The mud motor pressure, which increases with weight on bit, is difficult to isolate from the internal pressure measurement (which includes annulus pressure drop, bit pressure drop, motor pressure drop, measurement while drilling pressure drop, and drill string pressure drop components). Though it is assumed when estimating mud motor differential pressure that the pressure drop across the mud motor is zero when the bit is off bottom downhole, that is not always the case. When a steerable assembly is in the hole, the bit may contact the side wall of the hole and cause reactive torque at the mud motor. When zeroing the differential while the bit is off bottom, this load (from the reactive torque) is removed as well, such that any pressure increase seen as going to bottom of the hole does not include this already-existing load on the mud motor.

Autodrillers typically use the current weight on bit estimation from the hookload signal during vertical drilling to keep a constant load on the drill bit. In directional drilling, however, the weight on bit estimate is not used because current approaches result in a weight on bit estimation that is not correct during directional drilling. Further, weight on bit estimates are currently used in mechanical specific energy (MSE) calculations, though they are not correct during directional drilling. As a result, the MSE calculations are likewise not correct during directional drilling. Another variable that is often poorly estimated is torque on bit, which currently is estimated based on top drive torque.

Though the current weight on bit may be used in autodrillers, problems arise when hookload is used for determining weight on bit. This is because the use of hookload relies upon the assumption that, as the drill string is lowered and touches bottom, the observed difference in hookload is all transferred to the bit at bottom. In reality, (for example in long lateral wells), frictional forces at various sticking points along the wellbore causes the drill pipe to bend as the drill string is lowered and a portion of the lost weight at the hook is supported by the bottom side of the horizontal hole and not the end of the hole where the bit is located. At the surface, this is measured as a lowering of the drill string and a reduction of hookload, though not all of the reduced hookload is transferred to the bit at bottom. At some point, the load on the sticking points in the wellbore is high enough that it overcomes the frictional forces. The drill string slips lower as a result, causing more of the weight to transfer to the bit. Such spikes in the downhole weight on bit can unnecessarily damage downhole equipment.

The present disclosure is directed to systems, devices, and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
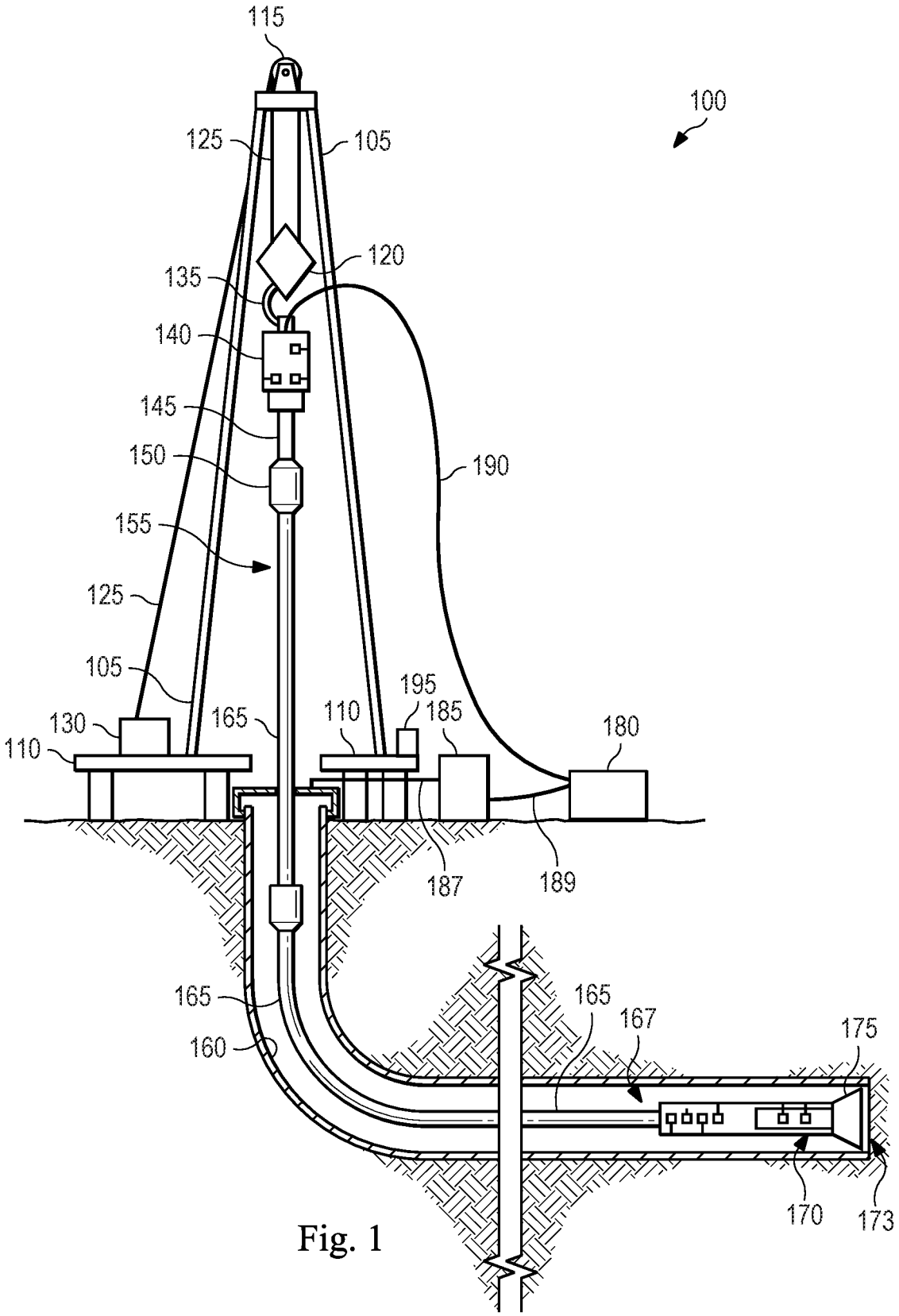
FIG. 1 is a schematic of an apparatus shown as an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Embodiments of the present disclosure include a drilling rig apparatus for improving autodriller control using determined relationships between downhole measurement data to estimate weight on bit (WOB) and torque on bit (TOB) using surface measurement data and using estimated downhole WOB data to prevent sudden increases of actual WOB downhole.

In some examples, a bottom hole assembly (BHA) receives actual downhole differential pressure measurements (e.g., annulus pressure, bore pressure, etc., from which differential pressure may be calculated, or estimated if one pressure value is available), actual downhole WOB measurements, and actual downhole TOB measurements. These measurements may be buffered for a period of time before analysis is performed on them by a controller at the BHA (with, e.g., the analysis triggered either by passage of time or some other triggering condition). The BHA controller determines a relationship between the downhole differential pressure measurements and the downhole WOB, which may result in one or more coefficients for a WOB formula that relates differential pressure to WOB. Similarly, the BHA controller determines a relationship between the downhole differential pressure measurements and the downhole TOB, which may also result in one or more coefficients for a TOB formula that relates differential pressure to TOB.

The BHA controller may either periodically transmit the determined relationships to a surface controller or transmit the determined relationships once it is determined that they differ above a threshold amount from any prior established relationships. At the surface controller, when relationships are received from the BHA controller, for example as coefficients, the coefficients are implemented in respective formulas. For example, WOB coefficients may be implemented by a WOB formula at the surface controller and the TOB coefficients may be implemented by a TOB formula at the surface controller. The surface controller may, with the coefficients implemented, receive surface differential pressure measurements at a higher rate than downhole differential pressure measurements (e.g., due to the transmission time that may occur over potentially large distance) in order to drive an autodriller.

The surface controller may estimate new downhole WOB and downhole TOB values each time that a new surface differential pressure measurement is received, and use the estimated values as inputs into an autodriller feedback loop and also to calculate MSE. Thereby, autodriller control may be improved and shut down limits improved, including during directional drilling operations.

Further, the surface controller may receive estimated downhole WOB or actual downhole WOB values transmitted from the BHA and compare a ratio between the new downhole WOB and a new surface-determined WOB value and one or more prior ratios. If the result of the comparison identifies a negative change value between the two ratios, then the surface controller may change (e.g., reduce or zero) a slack-off rate of the drill string in the wellbore to reduce or stop adding energy to the drill string that is not reaching the drill bit. One or more parameters are adjusted until the ratio (e.g., updated as new WOB values are obtained, determined, and/or estimated) becomes zero or positive again, at which point the slack-off rate may increase again.

Accordingly, embodiments of the present disclosure provide improvements to autodriller control using determined relationships between downhole measurement data to estimate WOB and TOB using surface measurement data. Further, bit wear is improved as sudden increases of actual downhole WOB are mitigated/prevented.

FIG. 1 is a schematic of a side view of an exemplary drilling rig 100 according to one or more aspects of the present disclosure. In some examples, the drilling rig 100 may form a part of a land-based, mobile drilling rig. However, one or more aspects of the present disclosure are applicable or readily adaptable to any type of drilling rig with supporting drilling elements, for example, the rig may include any of jack-up rigs, semisubmersibles, drill ships, coil tubing rigs, well service rigs adapted for drilling and/or re-entry operations, and casing drilling rigs, among others within the scope of the present disclosure.

The drilling rig 100 includes a mast 105 supporting lifting gear above a rig floor 110. The lifting gear may include a crown block 115 and a traveling block 120. The crown block 115 is coupled at or near the top of the mast 105, and the traveling block 120 hangs from the crown block 115 by a drilling line 125. One end of the drilling line 125 extends from the lifting gear to axial drive 130. In some implementations, axial drive 130 is a drawworks, which is configured to reel out and reel in the drilling line 125 to cause the traveling block 120 to be lowered and raised relative to the rig floor 110. The other end of the drilling line 125, known as a dead line anchor, is anchored to a fixed position, possibly near the axial drive 130 or elsewhere on the rig. Other types of hoisting/lowering mechanisms may be used as axial drive 130 (e.g., rack and pinion traveling blocks as just one example), though in the following reference will be made to axial drive 130 (also referred to simply as a drawworks herein) for ease of illustration.

A hook 135 is attached to the bottom of the traveling block 120. A drill string rotary device 140, of which a top drive is an example, is suspended from the hook 135. Reference will be made herein simply to top drive 140 for simplicity of discussion. A quill 145 extending from the top drive 140 is attached to a saver sub 150 configured according to embodiments of the present disclosure, which is attached to a drill string 155 suspended within a wellbore 160. The term "quill" as used herein is not limited to a component which directly extends from the top drive 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, for the sake of clarity and conciseness, these components may be collectively referred to herein as the "quill." It should be understood that other techniques for arranging a rig may not require a drilling line, and are included in the scope of this disclosure.

The drill string 155 includes interconnected sections of drill pipe 165, a bottom hole assembly (BHA) 170, and a drill bit 175 for drilling at bottom 173 of the wellbore 160. The BHA 170 may include stabilizers, drill collars, and/or measurement-while-drilling (MWD) or wireline conveyed instruments, among other components. The drill bit 175 is connected to the bottom of the BHA 170 or is otherwise attached to the drill string 155. In the exemplary embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

A mud pump system 180 receives the drilling fluid, or mud, from a mud tank assembly 185 and delivers the mud to the drill string 155 through a hose or other conduit 190, which may be fluidically and/or actually connected to the top drive 140. In some implementations, the mud may have a density of at least 9 pounds per gallon. As more mud is pushed through the drill string 155, the mud flows through the drill bit 175 and fills the annulus 167 that is formed between the drill string 155 and the inside of the wellbore 160, and is pushed to the surface. At the surface the mud tank assembly 185 recovers the mud from the annulus 167 via a conduit 187 and separates out the cuttings. The mud tank assembly 185 may include a boiler, a mud mixer, a mud elevator, and mud storage tanks. After cleaning the mud, the mud is transferred from the mud tank assembly 185 to the mud pump system 180 via a conduit 189 or plurality of conduits 189. When the circulation of the mud is no longer needed, the mud pump system 180 may be removed from the drill site and transferred to another drill site.

The drilling rig 100 also includes a control system 195 configured to control or assist in the control of one or more components of the drilling rig 100. For example, the control system 195 may be configured to transmit operational control signals to the drawworks 130, the top drive 140, the BHA 170 and/or the mud pump system 180. The control system 195 may be a stand-alone component installed somewhere on or near the drilling rig 100, e.g. near the mast 105 and/or other components of the drilling rig 100, or on the rig floor to name just a few examples. In some embodiments, the control system 195 is physically displaced at a location separate and apart from the drilling rig, such as in a trailer in communication with the rest of the drilling rig. As used herein, terms such as "drilling rig" or "drilling rig apparatus" may include the control system 195 whether located at or remote from the drilling rig 100.

According to embodiments of the present disclosure, the control system 195 may include, among other things, an interface configured to receive inputs from a controller at the BHA 170. For example, the controller at the BHA 170 may determine a relationship between different parameters measured downhole near the drill bit 175, such as downhole weight on bit (WOB), downhole torque on bit (TOB), and downhole differential pressure (downhole ΔP) to name a few examples. For example, the controller at the BHA 170 may determine a relationship between downhole ΔP and downhole WOB, as well as downhole ΔP and downhole TOB, over discrete periods of time. Those relationships may be established in the form of coefficients for a formula relating a ΔP value to the downhole WOB value.

The control system 195 may receive these coefficients from the BHA 170 via a variety of connection and communication types, for example telemetry, mud pulse, electromagnetic signals, wired pipe, any other suitable option, or any combination thereof. The control system 195 may implement the received coefficients (i.e., one or more coefficients identifying the relationship between downhole WOB and downhole ΔP and one or more coefficients identifying the relationship between downhole TOB and downhole ΔP) in a formula that receives as an input at least surface ΔP from a surface ΔP sensor (other inputs may be used as well), as discussed in more detail below.

The formula outputs, for WOB, an estimated downhole WOB based on the input surface ΔP and the coefficients implemented in the formula at the control system 195. Further, the formula outputs, for TOB, an estimated downhole TOB based on the input surface ΔP and the coefficients for TOB implemented at the control system 195. The control system 195 controls the rate of penetration for the drilling operation, for example, by adjusting drilling parameters to achieve a target WOB (i.e., so as not to exceed the target WOB) based on the estimated downhole WOB (and, where used, the estimated downhole TOB).

Further, the control system 195 may use the estimated downhole WOB or a true downhole WOB value to prevent a sudden increase of actual WOB downhole. For example, with an accurate downhole WOB value (whether received via communication directly from sensors at the BHA 170 or estimated using the coefficients as mentioned above), the control system 195 is able to track a ratio of the downhole WOB (whether actual or estimated) to a surface WOB-determined value (e.g., determined from hookload measurements). If the control system 195 determines that a change value of the ratio (tracked over time) stops having a positive or zero value, it may change the drilling parameters to reduce the weight transfer or stop it until the ratio achieves a zero or positive change value again, as will be discussed in more detail below.

While changed or zeroed, the autodriller operations implemented by the controller 195 may also adjust other parameters such as oscillation speed and toolface orientation in order to assist in improving the change value of the ratio to a zero or positive value. The control system 195 may repeatedly alternate between adjusting the hookload to manipulate WOB and other parameters until the change value of the ratio becomes zero or positive again. Thereby, the control system 195 may prevent situations where surface weight is increased to increase surface ΔP measurements to a target value while that weight increase is not reaching the actual bit at bottom. In some examples, the ratio comparisons may begin when the drill bit 175 kicks off from a curve in directional drilling, while in other examples the ratio comparisons may be used in various portions of drilling to protect against sudden increases in downhole WOB beyond acceptable bounds.

Figure 2:
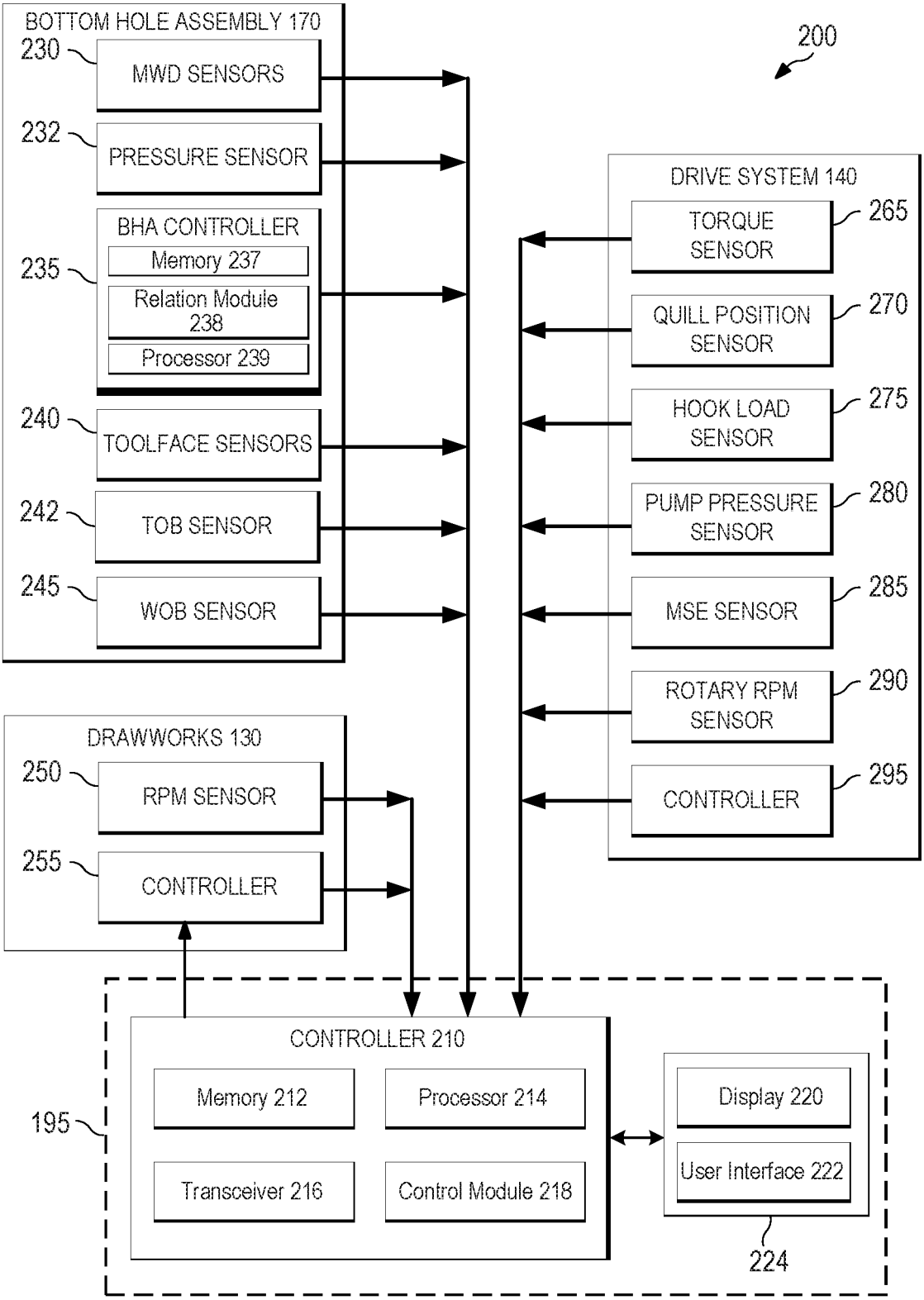
FIG. 2 is a block diagram of an apparatus shown as an exemplary control system according to one or more aspects of the present disclosure.

Turning to FIG. 2, a block diagram of an exemplary control system configuration 200 according to one or more aspects of the present disclosure is illustrated. In some implementations, the control system configuration 200 may be described with respect to the drawworks 130, top drive 140, BHA 170, and autodriller control system 195. The control system configuration 200 may be implemented within the environment and/or the apparatus shown in FIG. 1.

The control system configuration 200 may include a BHA controller 235 at the BHA 170, a drawworks controller 255 at the drawworks 130, a controller 295 at the top drive system 140, and the control system 195. The control system 195 may include a controller 210 and may also include an interface system 224. Depending on the embodiment, these may be discrete components that are interconnected via wired and/or wireless means. In some embodiments, the interface system 224 and the controller 210 may be integral components of a single system that is in communication with the other controllers, including the BHA controller 235, the drawworks controller 255, and the controller 295.

The BHA controller 235 may include at least a memory 237, a processor 239, and a relation module 238. The memory 237 may include a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some embodiments, the memory 237 may include a non-transitory computer-readable medium.

The memory 237 may store instructions. The instructions may include instructions that, when executed by the processor 239, cause the processor 239 to perform operations described herein with reference to the BHA controller 235 in connection with embodiments of the present disclosure. The terms "instructions" and "code" may include any type of computer-readable statement(s). For example, the terms "instructions" and "code" may refer to one or more programs, routines, sub-routines, functions, procedures, etc. "Instructions" and "code" may include a single computer-readable statement or many computer-readable statements.

The processor 239 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the BHA controller 235 introduced in FIG. 1 above. The processor 239 may also be implemented as a combination of computing devices, e.g., a combination of a DSP and a microprocessor, a plurality of microprocessors, one or more microprocessors in conjunction with a DSP core, or any other such configuration.

In addition to the BHA controller 235, the BHA 170 may include one or more sensors, typically a plurality of sensors, located and configured about the BHA 170 to detect parameters relating to the drilling environment, the BHA 170 condition and orientation, and other information. The BHA 170 may include additional sensors/components beyond those illustrated in FIG. 2, which is simplified for purposes of illustration. The sensors/components may provide information that may be considered by the controller 235 and/or the control system 195, for example downhole WOB, downhole TOB, downhole ΔP, and/or other data.

In the embodiment shown in FIG. 2, the BHA 170 includes MWD sensors 230. For example, the MWD sensor 230 may include an MWD shock/vibration sensor that is configured to detect shock and/or vibration in the MWD portion of the BHA 170, and an MWD torque sensor that is configured to detect a value or range of values for torque applied to the bit by the motor(s) of the BHA 170 (referred to generally herein as downhole TOB). The MWD sensors 230 may also include an MWD RPM sensor that is configured to detect the RPM of the bit of the BHA 170. The data from these sensors may be sent via electronic signal or other signal to the controller 235 and/or control system 195 as well via wired and/or wireless transmission.

The BHA 170 may also include a downhole mud motor ΔP (differential pressure) sensor 232 (referred to simply herein as a downhole ΔP sensor 232) that is configured to detect a pressure differential value or range across the mud motor of the BHA 170. This may be a value in reference to the pressure just off-bottom and pressure once the bit touches bottom and starts drilling and experiencing torque.

The BHA 170 may also include one or more toolface sensors 240, such as a magnetic toolface sensor and a gravity toolface sensor that are cooperatively configured to detect the current toolface orientation, such as relative to magnetic north. The gravity toolface may detect toolface orientation relative to the Earth's gravitational field. In an exemplary embodiment, the magnetic toolface sensor may detect the current toolface when the end of the wellbore is less than about 7° from vertical, and the gravity toolface sensor may detect the current toolface when the end of the wellbore is greater than about 7° from vertical.

The BHA 170 may also include an MWD torque on bit sensor 242 (referred to simply herein as a downhole TOB sensor 242) that is configured to detect a value or range of values for downhole TOB at or near the BHA 170. The data from the downhole TOB sensor 242 may be sent via electronic signal or other signal to the controller 235 and/or control system 195 via wired and/or wireless transmission.

The BHA 170 may also include an MWD WOB sensor 245 (referred to simply herein as a downhole WOB sensor 245) that is configured to detect a value or range of values for downhole WOB at or near the BHA 170. The data from these sensors may be sent via electronic signal or other signal to the controller 235 and/or control system 195 via wired and/or wireless transmission.

Returning to discussion of the BHA controller 235, the downhole WOB, the downhole TOB, and the downhole ΔP may be input to the controller 235. For example, the relation module 238 may receive the parameters from the respective sensors, or alternatively the parameters may be stored in a buffer (referred to herein simply as a buffer, though any number of buffers may be used, i.e. one shared buffer, or a separate buffer for each parameter being logged as discussed herein) provided by the memory 237 over a period of time before analysis is performed by the relation module 238 at the BHA controller 235.

The relation module 238 may include various hardware components and/or software components to implement the aspects of the present disclosure. For example, in some implementations the relation module 238 may include instructions stored in the memory 237 that causes the processor 239 to perform the operations described herein. In an alternative embodiment, the relation module 238 is a hardware module that interacts with the other components of the BHA controller 235 to perform the operations described herein.

The relation module 238 is used to determine a relationship between the downhole WOB and the downhole ΔP, and also in embodiments between the downhole TOB and the downhole ΔP. The relationships thus determined may be transmitted to the controller 210 at the surface for subsequent implementation as introduced above and discussed further below.

For example, the relation module 238 may receive the collected downhole WOB measurements that have been maintained in the buffer in the memory 237 over a prior period of time, for example on the order of several minutes as just one example, as well as downhole ΔP measurements obtained and maintained in the buffer in the memory 237 over the same prior period of time.

The relation module 238 runs the values through an algorithm to determine a relationship between the parameters, i.e. relate downhole ΔP measurements to the downhole WOB measurements. For example, the relation module 238 may implement a time series regression for linear systems, such as autoregressive moving average (ARMA) models, autoregressive integrated moving average (ARIMA) models, and nearest neighbor (NN) models, to name just a few examples (any of which may be implemented individually or collectively by the relation module 238).

As another example, the relation module 238 may implement a time series regression for non-linear systems, such as a hybrid learning algorithm like the artificial neuro-fuzzy inference systems (ANFIS) models for establishing a non-linear relationship between the downhole ΔP measurements and the downhole WOB measurements. As yet another example, the relation module 238 may implement a piece-wise linear table to establish the relationship.

Whatever the approach, the relation module 238 may generate a relationship based on the analysis of the downhole ΔP measurements and the downhole WOB measurements. For example, an output of the relation module 238, and therefore the BHA controller 235, may be in the form of one or more coefficients, such as of a polynomial for a non-linear system or of a line equation or transfer function for a linear system. For example, the BHA controller 235 may be configured (either before drilling commences or during drilling) with a WOB polynomial (for a non-linear system, or a transfer function/line equation for a linear system) with a predetermined number of WOB coefficients that the relation module 238 determines in operation, with the same WOB polynomial (or transfer function/line equation depending on system type) with the same predetermined number of WOB coefficients configured at the control system 195 at the surface. Thus, transmission of the WOB coefficients may be sufficient (instead of an entire equation) to reduce the amount of data required to be transmitted from the BHA controller 235 to the surface.

As another example, the relation module 238 may also receive the collected downhole TOB measurements that have been maintained in the buffer in the memory 237 over a prior period of time, for example on the same order of several minutes as just one example, as well as the downhole ΔP measurements obtained and maintained in the buffer in the memory 237 over the same prior period of time and as discussed above.

The relation module 238 runs the values involving the downhole TOB also through an algorithm to determine a relationship between the parameters, i.e. relate downhole ΔP measurements to the downhole TOB measurements. The same linear or non-linear model, or same or different linear model, may be used as with the WOB calculations discussed above, on the downhole ΔP measurements and downhole TOB measurements. As a further alternative, the relation module 238 may implement a piece-wise linear table to establish the relationship.

Whatever the approach, the relation module 238 may generate a relationship based on the analysis of the downhole ΔP measurements and the downhole TOB measurements. For example, an output of the relation module 238, and therefore the BHA controller 235, may be in the form of one or more coefficients of a polynomial (or of a line equation/transfer function for a linear system) for the TOB relationship specifically. For example, the BHA controller 235 may be configured (either before drilling commences or during drilling) with a TOB polynomial (for a non-linear system, or a transfer function/line equation for a linear system) with a predetermined number of coefficients that the relation module 238 determines in operation, with the same TOB polynomial (or transfer function/line equation depending on system type) with the same predetermined number of coefficients configured at the control system 195 at the surface. Thus, transmission of the TOB coefficients may be sufficient (instead of an entire equation) to reduce the amount of data required to be transmitted from the BHA controller 235 to the surface as well.

The WOB coefficients and the TOB coefficients may be transmitted separately or collectively to the surface control system 195. For example, the transmission may occur via telemetry, mud pulse, EM, wired pipe, or other types of connections including for example local area network (LAN), wide area network (WAN), etc. In some examples, the formula at the surface control system 195 may be preconfigured with coefficients (one or more), such as based on estimates determined from predicted properties of the formations and/or material properties (i.e., drill string characteristics, etc.), or based on recent coefficients used in a recent drilling operation. Thereafter, the coefficients may be updated with the WOB and/or TOB coefficients as discussed above.

Further, the WOB coefficients may be transmitted to the surface control system 195 at a periodic basis or on a dynamic basis after an initial transmission. For example, the periodic basis may coincide with the period of time that the memory 237 buffers past downhole WOB, downhole TOB, and downhole ΔP measurements. Thus, when the relation module 238 runs the values involving either the WOB, TOB, and/or both through their respective algorithms (e.g., executed by the processor 239 of the BHA controller 235), the BHA controller 235 may in turn transmit the one or more coefficients output from each algorithm (or a combined algorithm, where applicable) to the surface control system 195. As another example, the periodic basis may be different (e.g., longer) than the buffering periods of time in which the algorithms are run (or either of the WOB/TOB algorithms separately).

Further, the periodic basis may dynamically change during drilling. For example, the BHA controller 235 may initially send new coefficients to the surface control system 195 at a first periodic basis. For simplicity of discussion, reference will be made to downhole WOB measurements/coefficients while also applicable to downhole TOB as well. At the end of a new period of time for buffering data at the memory 237, the BHA controller 235 may generate the coefficients for the buffered downhole WOB and downhole ΔP measurements. The BHA controller 235 may compare the new coefficients to the existing coefficients (i.e., the coefficients currently in transmission to, or received and in use at, the surface control system 195). For example, the comparison may be a difference value between them.

The BHA controller 235 may compare the result of the comparison, e.g. the difference value, to a threshold value. The threshold value may be a value that is predetermined and pre-installed at the BHA controller 235. Alternatively, the threshold value may be some percentage value of the existing coefficients. The BHA controller 235 may determine to transmit the new coefficients to the surface control system 195 (to replace the existing coefficients) if the result of the comparison is greater than the threshold value (or greater than or equal to, in some embodiments). Otherwise, the BHA controller 235 may determine to not transmit the new coefficients. Alternatively, the BHA controller 235 may transmit new coefficients at the end of each new period of time and the surface control system 195 may perform the above-discussed comparison to a threshold value and determine therefrom whether to replace the existing coefficients or not.

The downhole TOB coefficients may also be transmitted to the surface control system 195 according to a similar procedure as that discussed in the example regarding the downhole WOB coefficients, with comparisons to the existing TOB coefficients at the surface and the new TOB coefficients and to TOB thresholds. Thus, new relationships between downhole WOB and downhole ΔP, and between downhole TOB and downhole ΔP, may be periodically transmitted to the surface to adapt to changing downhole conditions (e.g., changes in formation).

At the surface, the control system 195 may receive the data transmitted from the downhole components, including from the BHA controller 235 and, in some embodiments, one or more of the downhole sensors as well. The controller 210 of the control system 195 may use this data as discussed further herein.

The controller 210 includes a memory 212, a processor 214, a transceiver 216, and a control module 218 (also referred to as an autodriller in some embodiments). The memory 212 may include a cache memory (e.g., a cache memory of the processor 214), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some embodiments, the memory 212 may include a non-transitory computer-readable medium. The memory 212 may store instructions. The instructions may include instructions that, when executed by the processor 214, cause the processor 214 to perform operations described herein with reference to the controller 210 in connection with embodiments of the present disclosure.

The processor 214 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the autodriller aspects introduced in FIG. 1 above. The processor 214 may also be implemented as a combination of computing devices, e.g., a combination of a DSP and a microprocessor, a plurality of microprocessors, one or more microprocessors in conjunction with a DSP core, or any other such configuration.

The transceiver 216 may include a LAN, WAN, Internet, satellite-link, and/or radio interface to communicate bi-directionally with other devices, such as the top drive 140, drawworks 130, BHA 170, and other networked elements. For example, the transceiver 216 may include multiple ports corresponding to the different connections/access technologies used to communicate between components and locations (e.g., different ports for communication connections, as well as with different sensors that provide inputs into the controller 210 for autodrilling control, etc.).

The control system 195 may also include an interface system 224. The interface system 224 includes a display 220 and a user interface 222. The interface system 224 may also include a memory and a processor as described above with respect to controller 210. In some implementations, the interface system 224 is separate from the controller 210, while in other implementations the interface system 224 is part of the controller 210. Further, the interface system 224 may include a user interface 222 with a simplified display 220 or, in some embodiments, not include the display 220.

The display 220 may be used for visually presenting information to the user in textual, graphic, or video form. The display 220 may also be utilized by the user to input drilling parameters, limits, or set point data in conjunction with the input mechanism of the user interface 222, such as a set point for a desired differential pressure, weight on bit, torque on bit, rate of penetration, etc. for use in autodrilling control according to embodiments of the present disclosure. The set point for the differential pressure (alone or also weight on bit where used as well) may be received before drilling begins and may be updated dynamically during drilling operations. For example, the input mechanism may be integral to or otherwise communicably coupled with the display 220. The input mechanism of the user interface 222 may also be used to input additional settings or parameters.

The input mechanism of the user interface 222 may include a keypad, voice-recognition apparatus, dial, button, switch, slide selector, toggle, joystick, mouse, data base and/or other conventional or future-developed data input device. Such a user interface 222 may support data input from local and/or remote locations. Alternatively, or additionally, the user interface 222 may permit user-selection of predetermined profiles, algorithms, set point values or ranges, and well plan profiles/data, such as via one or more drop-down menus. The data may also or alternatively be selected by the controller 210 via the execution of one or more database look-up procedures. In general, the user interface 222 and/or other components within the scope of the present disclosure support operation and/or monitoring from stations on the rig site as well as one or more remote locations with a communications link to the system, network, LAN, WAN, Internet, satellite-link, and/or radio, among other means.

Turning to the top drive 140 components, the top drive 140 includes one or more sensors or detectors. The top drive 140 includes a rotary torque sensor 265 (also referred to herein as a torque sensor 265) that is configured to detect a value or range of the reactive torsion of the quill 145 or drill string 155. For example, the torque sensor 265 may be a torque sub physically located between the top drive 140 and the drill string 155. As another example, the torque sensor 265 may additionally or alternative be configured to detect a value or range of torque output by the top drive 140 (or commanded to be output by the top drive 140), and derive the torque at the drill string 155 based on that measurement. Detected voltage and/or current may be used to derive the torque at the interface of the drill string 155 and the top drive 140. The controller 295 is used to control the rotational position, speed and direction of the quill 145 or other drill string component coupled to the top drive 140 (such as the quill 145 shown in FIG. 1), shown in FIG. 2. The torque data may be sent via electronic signal or other signal to the controller 210 via wired and/or wireless transmission (e.g., to the transceiver 216).

The top drive 140 may also include a quill position sensor 270 that is configured to detect a value or range of the rotational position of the quill, such as relative to true north or another stationary reference. The top drive 140 may also include a hook load sensor 275 (e.g., that detects the load on the hook 135 as it suspends the top drive 140 and the drill string 155) and a rotary RPM sensor 290. The rotary RPM sensor 290 is configured to detect the rotary RPM of the drill string 155. This may be measured at the top drive or elsewhere, such as at surface portion of the drill string 155 (e.g., reading an encoder on the motor of the top drive 140).

These signals, including the RPM detected by the RPM sensor 290, may be sent via electronic signal or other signal to the controller 210 via wired and/or wireless transmission.

The drive system represented by top drive 140 also includes a surface pump pressure sensor or gauge 280 (e.g., that detects the pressure of the pump providing mud or otherwise powering the down-hole motor in the BHA 170 from the surface) that will be referred to herein as a surface differential pressure (ΔP) sensor 280. The surface ΔP sensor 280 is configured to detect a pressure differential value between the surface standpipe pressure while the BHA 170 is just off-bottom from bottom 173 and surface standpipe pressure once the bit of BHA 170 touches bottom 173 and starts drilling and experiencing torque (and generating cuttings). Typically, the surface ΔP detected by the surface ΔP sensor 280 represents how much pressure the mud motor at the BHA 170 is generating in the system, which is a function of mud motor torque.

The drive system represented by top drive 140 may also include an MSE sensor 285. The MSE sensor 285 may detect the MSE representing the amount of energy required per unit volume of drilled rock to remove it, whether directly sensed or calculated based on sensed data. For example, the MSE may be calculated based on sensed data including the surface differential pressure from the surface ΔP sensor 280 and an estimated downhole WOB as discussed further below. This may provide a more accurate MSE for use in various operations, made possible by embodiments of the present disclosure.

The drawworks 130 may include one or more sensors or detectors that provide information to the controller 210. The drawworks 130 may include an RPM sensor 250. The RPM sensor 250 is configured to detect the rotary RPM of the drilling line 125, which corresponds to the speed of hoisting/lowering of the drill string 155. This may be measured at the drawworks 130. The RPM detected by the RPM sensor 250 may be sent via electronic signal or other signal to the controller 210 via wired or wireless transmission. The drawworks 130 may also include a controller 255. The controller 255 is used to control the speed at which the drill string 155 is hoisted or lowered, for example as dictated by the control system 195 according to embodiments of the present disclosure (e.g., in response to estimated downhole WOB values from surface ΔP measurements).

Returning to the controller 210, the control module 218 may be used for various aspects of the present disclosure. The control module 218 may include various hardware components and/or software components to implement the aspects of the present disclosure. For example, in some implementations the control module 218 may include instructions stored in the memory 212 that causes the processor 214 to perform the operations described herein. In an alternative embodiment, the control module 218 is a hardware module that interacts with the other components of the controller 210 to perform the operations described herein.

The control module 218 is used to estimate the downhole WOB and downhole TOB values based on the most recent WOB and TOB coefficients received from the BHA controller 235, respectively. For example, the control module 218 may receive the one or more coefficients determined to represent the relationship between downhole ΔP and the downhole WOB measurements over a past period of time. The control module 218 may further receive the one or more coefficients determined to represent the relationship between downhole ΔP and the downhole TOB measurements over a past period of time. The control module 218 may store these coefficients in the memory 212 for use over time in respective formulas for estimating downhole WOB and downhole TOB until the next set of coefficients is received (or either for TOB or WOB alone, depending on circumstance) from the BHA controller 235.

In some examples, the control module 218 may implement coefficients when they are received from the BHA controller 235, i.e. according to a set periodic basis or in response to the BHA controller 235 determining that a difference between the existing coefficients and the new coefficients exceed (or meet) a threshold value. In other examples, the control module 218 may make the comparison and thresholding instead of the BHA controller 235, in which case the control module 218 may implement the coefficients if the threshold is exceeded (or met, where applicable) and discard the new coefficients otherwise.

The control module 218 may, with the implemented coefficients for WOB, estimate downhole WOB using a surface ΔP measurement. Further, the control module 218 may estimate downhole TOB using a surface ΔP measurement with the implemented coefficients for TOB. For example with respect to downhole WOB in particular, the controller 210 may receive, from the surface ΔP sensor 280, a surface ΔP measurement (or a plurality). The control module 218 of the controller 210 may input the received surface ΔP measurement into the formula that has implemented the most recent coefficients for the downhole WOB and downhole ΔP measurements relationship. The formula may further take into account other material characteristics and input data, such as drill string model information, hookload data from the hook load sensor 275, etc., when calculating a downhole WOB estimate using the received surface ΔP measurement. The above may repeat each time that a new surface ΔP measurement is received, which may occur for example many times a second. Similarly, a downhole TOB may be estimated based on the received surface ΔP measurement (and any other input data, such as any of the other aspects discussed above) and the TOB coefficients received from the BHA controller 235. The downhole TOB estimation may occur multiple times a second as well.

The control system 195 (e.g., an autodriller component of the control system 195) may use the estimated downhole WOB to control the rate of penetration for the drilling operation (e.g., alone or in combination with an estimated downhole TOB). For example, the control system 195 may have set target downhole WOB, TOB, and/or rate of penetration values. With the estimated downhole WOB/TOB values, the control system 195 may additionally determine the current rate of penetration from the estimated and measured values. The estimated downhole WOB and/or downhole TOB values may be input into an autodriller feedback loop of the control system 195, for example as holding setpoints and/or shutting down limits. With the estimated downhole WOB and/or downhole TOB values, the autodriller feedback loop may adjust various drilling parameters of the top drive 140, drawworks 130, and/or BHA 170 to achieve a target WOB (i.e., to not exceed that value) and/or target TOB.

In addition to contributing to the autodriller feedback loop, the estimated downhole WOB (and estimated downhole TOB, where used and applicable) may be used in calculating the MSE. For example, the MSE may be calculated based on sensed data including the surface ΔP from the surface ΔP sensor 280 and the estimated downhole WOB. The estimated downhole WOB may be input into the formulas used to calculate MSE, for example. This may provide a more accurate MSE for use in various operations, made possible by embodiments of the present disclosure.

The control system 195, such as via the control module 218, may further assist in controlling drilling to prevent a sudden increase of downhole WOB due, for example, to frictional forces at various sticking points along the wellbore that cause drill pipe 165 to bend as the drill string 155 is lowered. Instead of relying on hookload measurements, the control module 218 may rely upon either the estimated downhole WOB or true downhole WOB values transmitted from the WOB sensor 245 downhole.

For example, the control module 218 may track the ratio of the estimated downhole WOB values to surface-determined WOB values (e.g., determined from hookload measurements from the hook load sensor 275). The control module 218 may generate the ratio as a value and perform different operations thereon. For example, the control module 218 may keep a running log of values for the ratio over time (e.g., within a time window or not). The running log may be plotted in some examples. The control module 218 may further compare the most recent ratio to one or more prior ratios. For example, the control module 218 may compare the most recent ratio to the ratio just prior to that (which may be updated each time a new surface ΔP measurement is received in the autodriller feedback loop). As another example, the control module 218 may compare the most recent ratio to an average of prior ratios (e.g., within a moving time window).

If the result of the comparison identifies a negative value for the change value between the two ratios, then the control module 218 may cause the control system 195 to change one or more drilling parameters to reduce the weight transfer from the top drive 140 to the drill string 155. For example, the control module 218 may reduce the slack-off rate of the drill string 155 in the wellbore 160, such as by increasing a braking mechanism on the drill string 155, or by directing the drawworks 130 to otherwise reduce or stop feeding the drill string 155 into the wellbore 160. The response is to thereby stop the increase of surface WOB and the increase of energy in the system that is not reaching the drill bit 175.

Further, the control module 218 may adjust other parameters, including for example oscillation speed (and optionally oscillation in either direction, such as to overcome obstacles in the wellbore 160, such as when performing a sliding operation), mud motor speed, and rate of penetration setpoint to name a few examples. These additional or alternative adjustments may also serve to address any undesired points of friction in the wellbore 160 on the drill string 155, so as to improve the ratio between the downhole WOB values to the surface-determined WOB values (which continue to be determined during these adjustments as new surface ΔP measurements are received). The control module 218 may alternate between adjusting the slack-off rate and the other parameters to improve the ratio to reach a zero or positive value again.

Once the ratio reaches a zero or positive value again, the control module 218 may cause the control system 195 to resume one or more of the changed drilling parameters to resume the weight transfer from the top drive 140 to the drill string 155 because at least a minimum amount is reaching the actual drill bit 175 at the bottom 173. The above approach may be implemented based on either the estimated downhole WOB values or "true" downhole WOB values received from the WOB sensor 245 (for example, in situations where a mode of communication is fast enough to feed the autodriller feedback loop for control of the system).

With the improved downhole WOB estimates (and TOB estimates), in addition to better controlling the rate of penetration for better bit wear and rate of penetration efficiencies, the MSE calculated may be more accurate.

Figure 3:
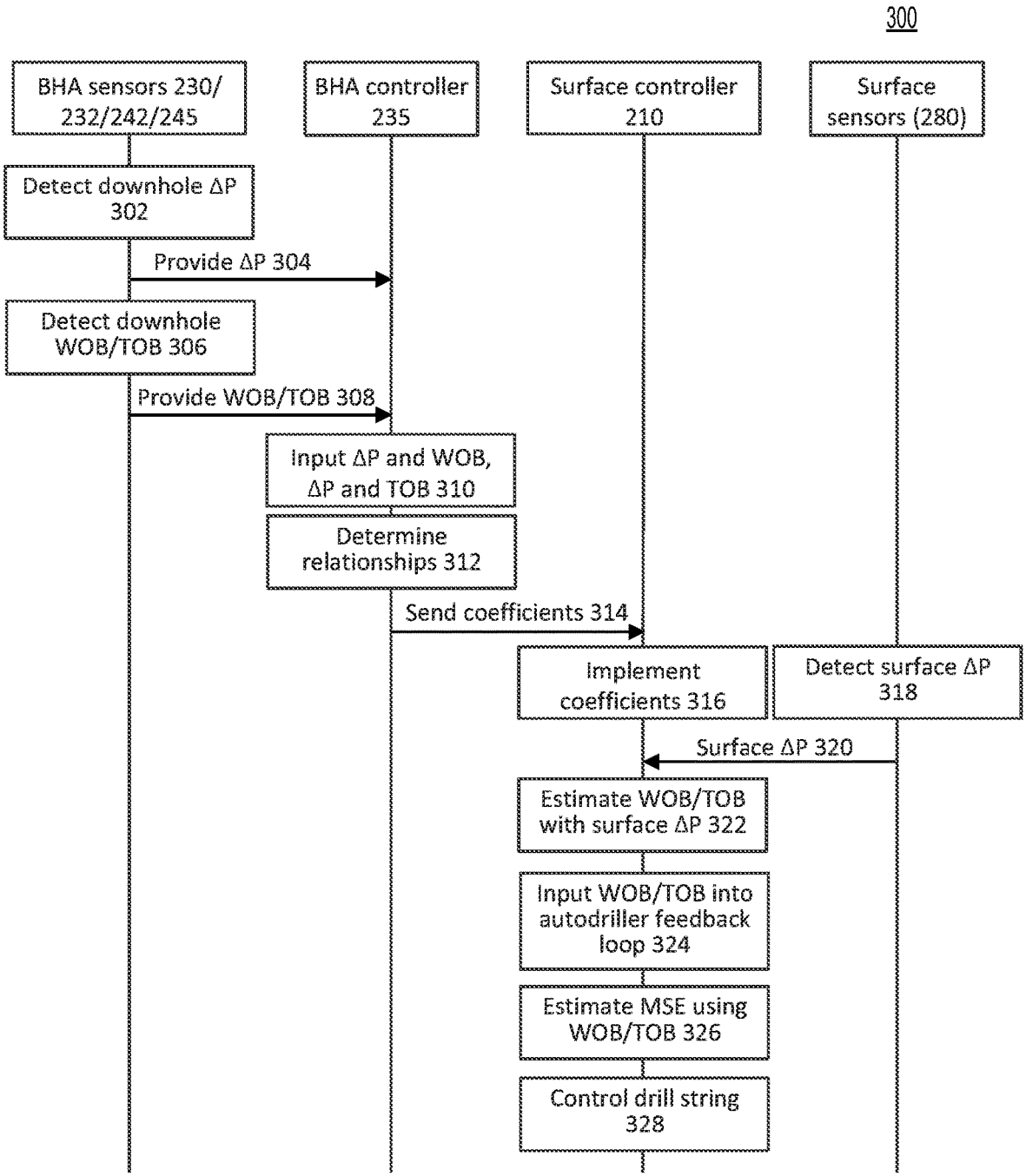
FIG. 3 is a diagram illustrating exemplary signaling between drilling rig components according to one or more aspects of the present disclosure.

Referring now to FIG. 3, shown is a protocol diagram 300 illustrating exemplary signaling aspects between drilling rig components such as BHA sensors (e.g., 230/232/242/245), BHA controller 235, surface controller 210, and surface sensors (e.g., 280) according to one or more aspects of the present disclosure.

At action 302, the downhole ΔP sensor 232 detects a downhole ΔP measurement during drilling operations. At action 304, the downhole ΔP sensor 232 provides (e.g., transmits) the downhole ΔP measurement from action 302 to the BHA controller 235.

At action 306, the downhole WOB sensor 245 detects the downhole WOB measurement, for example at approximately the same time as the detection at action 302. Also described as part of action 306, the downhole TOB sensor 242 detects the downhole TOB measurement, again for example at approximately the same time as the detection at action 302 (and approximately at the same time as the downhole WOB measurement). At action 308, the downhole WOB sensor 245 provides the downhole WOB measurement to the BHA controller 235, and the downhole TOB sensor 242 provides the downhole TOB measurement to the BHA controller 235 as well.

At action 310, the BHA controller 235 inputs the received downhole ΔP measurement and the downhole WOB measurement into an algorithm (such as by the relation module 238 of FIG. 2). Further, at the same or a different time the BHA controller 235 inputs the received downhole ΔP measurement and the downhole TOB measurement into an algorithm (e.g., separate from the algorithm for WOB or shared therewith). As noted above with respect to FIG. 2, the measurements may be respectively buffered of a period of time before input into the appropriate algorithm.

At action 312, the BHA controller 235 determines a relationship between the downhole ΔP measurement and the downhole WOB measurement (e.g., the buffered collection of measurements of the period of time). Further, the BHA controller 235 determines a relationship between the downhole ΔP measurement and the downhole TOB measurement (e.g., the buffered collection of measurements of the period of time). For example, the relation module 238 may implement a time series regression for linear or non-linear systems, or a piece-wise linear table(s). The relationship between the downhole ΔP measurement and the downhole WOB measurement (over the period of time) may be in the form of one or more coefficients. Further, the relationship between the downhole ΔP measurement and the downhole TOB measurement (over the period of time) may be in the form of one or more coefficients.

At action 314, the BHA controller 235 transmits the determined relationships for the WOB as well as the TOB measurements to the surface controller 210 of the surface control system 195. The transmission may be of coefficients only, as noted above with respect to FIG. 2.

At action 316, the surface controller 210 implements the received one or more coefficients for the relationship between downhole ΔP and downhole WOB in a formula used to estimate downhole WOB using surface ΔP as an input (other inputs may be included as well, such as drill string model information, measurements from other sensors such as flow and hookload, etc.). The surface controller 210 may also implement the one or more coefficients for the relationship between downhole ΔP and downhole TOB in a formula used to estimate downhole TOB using surface ΔP as an input (which may include other inputs as well, such as one or more of those discussed above). These coefficients may remain implemented in their respective formulas in respective formulas until new coefficients are received and that are determined to be implemented.

At action 318, the surface ΔP sensor 280 detects surface ΔP measurements, for example multiple measurements per second. Reference one given ΔP measurement is discussed for simplicity of illustration.

At action 320, the surface ΔP sensor 280 provides the surface ΔP measurement to the surface controller 210. As each surface ΔP measurement is detected, it may be provided to the surface controller 210.

At action 322, the surface controller 210, with the coefficients implemented in the appropriate formulas (or shared formula), receives the surface ΔP measurement from the surface ΔP sensor 280 and estimates the downhole WOB using the surface ΔP measurement. The surface controller 210 may also estimate the downhole TOB using the surface ΔP measurement and the implemented coefficients for the TOB.

At action 324, the surface controller 210 inputs the estimated downhole WOB into an autodriller feedback loop, and also in some examples the estimated downhole TOB.

At action 326, the surface controller 210 may use the estimated downhole WOB and the estimated downhole TOB in calculating the MSE. This may provide a more accurate MSE for use in various operations, made possible by embodiments of the present disclosure.

At action 328, the surface controller 210 may control the drill string 155 using the results of the input into the autodriller feedback loop. For example, the control system 195 may have set target downhole WOB, TOB, and/or rate of penetration values and the estimated downhole WOB and/or downhole TOB values may be used with the set targets to adjust various drilling parameters of the top drive 140, drawworks 130, and/or BHA 170 to achieve a target WOB (i.e., to not exceed that value) and/or target TOB.

The above actions may repeat as each surface ΔP measurement is input into the surface controller 210 and/or as new coefficients are received from the BHA 170. For example, actions 302-312 may repeat as new downhole measurements are obtained; actions 314-316 may repeat either at the periodic basis or as one or more thresholds are met for WOB and TOB coefficients; and actions 318-328 may repeat as new surface ΔP measurements are obtained.

Figure 4:
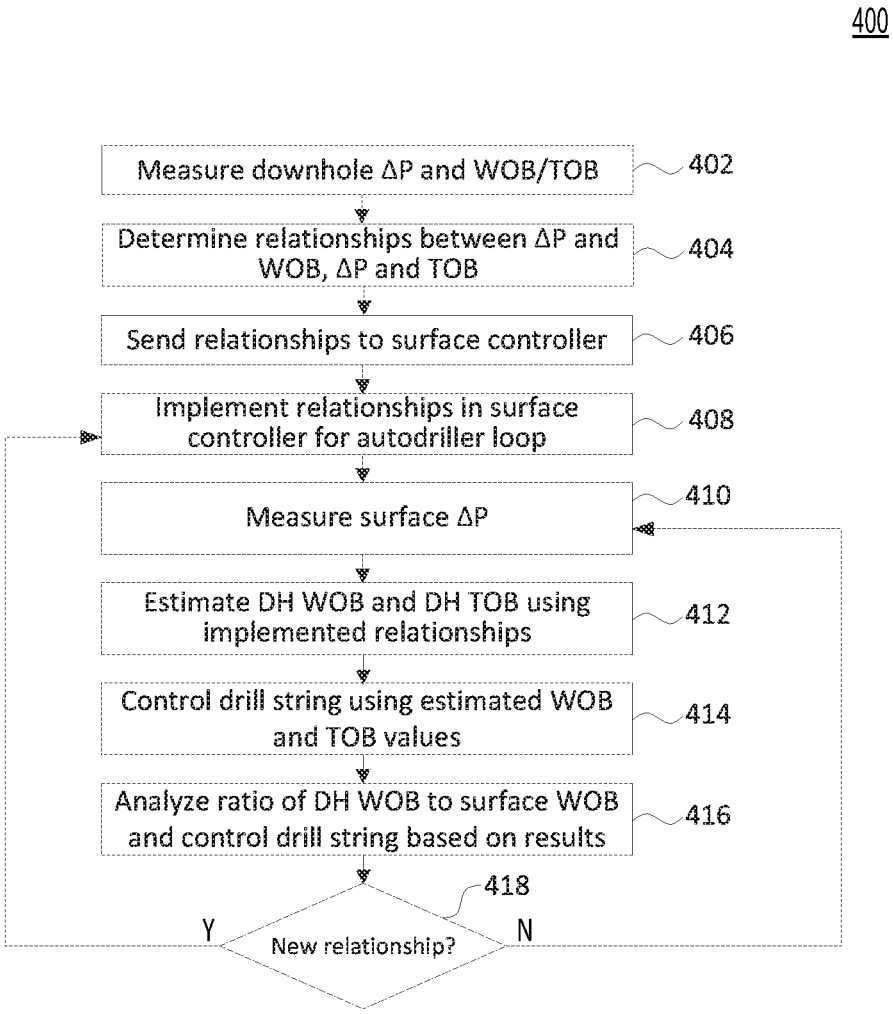
FIG. 4 is a flow chart showing an exemplary process for estimating downhole parameters for autodriller control according to aspects of the present disclosure.

FIG. 4 is a flow chart showing an exemplary process 400 for estimating downhole parameters for autodriller control according to aspects of the present disclosure. The method 400 may be performed, for example, with respect to the BHA 170 and control system 195 discussed above. For purposes of discussion, reference in FIG. 4 will be made to BHA 170 and control system 195 of FIG. 1. It is understood that additional steps can be provided before, during, and after the steps of method 400, and that some of the steps described can be replaced or eliminated from the method 400.

At block 402, the BHA 170 measures downhole ΔP, downhole WOB, and downhole TOB as the drill bit 175 is engaged with the bottom 173. For example, the downhole ΔP sensor 232 of the BHA 170 may detect the downhole ΔP, the downhole WOB sensor 245 may detect the downhole WOB, and the downhole TOB sensor 242 may detect the downhole TOB.

At block 404, the BHA 170 determines relationships between downhole ΔP and downhole WOB as well as between downhole ΔP and downhole TOB. For example, the BHA controller 235 may receive the measured values from block 402 as inputs after being buffered with multiple such measurements over time. The BHA controller 235 may use some form of regression (e.g., linear or non-linear, etc.) to determine the relationship, which may be expressed in the form of one or more WOB coefficients for the downhole ΔP-WOB relationship, and one or more TOB coefficients for the downhole ΔP-TOB relationship.

At block 406, the BHA 170 sends the determined relationships to the surface control system 195. For example, the coefficients may be transmitted on a periodic basis regardless of any amount of change (or lack thereof) between the new coefficients and the old coefficients sent previously to the surface. As another example, the coefficients may be transmitted only when their change from the existing coefficients (those coefficients currently implemented at the surface) meets or exceeds a threshold amount.

At block 408, the surface control system 195 (e.g., the controller 210) implements the coefficients for the downhole ΔP-WOB relationship and the coefficients for the downhole ΔP-TOB relationship in respective formula (or aspects of a common formula).

At block 410, surface ΔP is measured by a surface ΔP sensor 280 and input into the control system 195 for use in estimating downhole WOB and downhole TOB values, which are in turn used in an autodriller feedback loop (e.g., by the controller 210).

At block 412, the control system 195 estimates the downhole WOB value using the surface ΔP value measured at block 410, input into the formula for WOB that has implemented the downhole ΔP-WOB relationship (i.e., the coefficients from the BHA 170). Further, the control system 195 estimates the downhole TOB value using the surface ΔP value measured at block 410, input into the formula for TOB that has implemented the downhole ΔP-TOB relationships (i.e., the coefficients from the BHA 170).

At block 414, the control system 195 controls the drill string 155 using the estimated downhole WOB and estimated downhole TOB as inputs into the autodriller feedback loop. Other inputs to the autodriller feedback loop may be included as well, such as drill string model information, measurements from other sensors such as flow and hookload, etc. The control system 195 may also use the estimated downhole WOB and the estimated downhole TOB in calculating the MSE.

At block 416, the control system 195 analyzes the ratio between downhole WOB (whether estimated at block 412 or received from the BHA 170) and surface-determined WOB values (e.g., determined from hookload measurements from the hook load sensor 275) and controls the drill string 155 based on the results. The analysis may include a comparison between the most recent ratio to one or more prior ratios. If the result of the comparison identifies a negative value for the change value between the two ratios, then this may cause the control system 195 to change (e.g., reduce or zero) the slack-off rate of the drill string 155 in the wellbore 160 to reduce or stop feeding the drill string 155 into the wellbore 160.

Other parameters may also be adjusted as part of the control at block 416, including for example oscillation speed, mud motor speed, and rate of penetration setpoint to name a few examples. Adjustment may alternate between adjusting the slack-off rate and the other parameters to improve the ratio to reach a zero or positive value again. Once the ratio reaches a zero or positive value again, the control system 195 may resume one or more of the changed drilling parameters to resume the weight transfer from the top drive 140 to the drill string 155.

At decision block 418, if new coefficients have been received from the BHA 170, then the method 400 returns to block 408, where the received coefficients are implemented for their formula (or formulas, if coefficients for both WOB and TOB formulas are received). The method 400 may then proceed from block 408 as laid out above.

If instead at decision block 418 new coefficients have not been received, then the method 400 returns to block 410 with surface ΔP measurements used to estimate downhole WOB and downhole TOB values for use in autodrilling feedback loop and drill string 155 control. The method 400 may then proceed from block 410 as laid out above.

Figure 5:
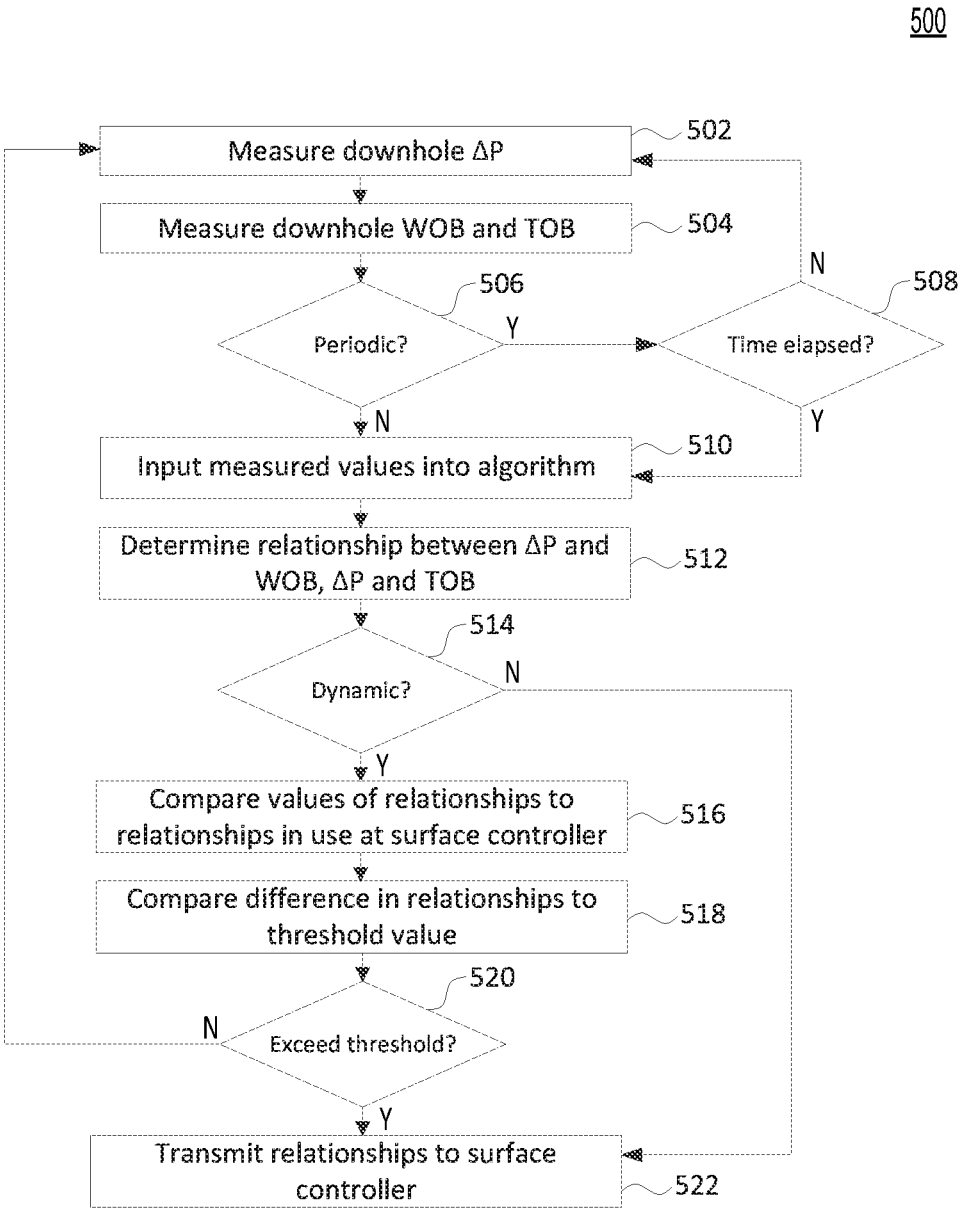
FIG. 5 is a flow chart showing an exemplary process for estimating downhole parameters for autodriller control according to aspects of the present disclosure.

Turning now to FIG. 5, a flow chart is illustrated showing an exemplary process 500 for estimating downhole parameters for autodriller control according to aspects of the present disclosure. The method 500 may be performed, for example, with respect to the BHA 170 discussed above. It is understood that additional steps can be provided before, during, and after the steps of method 500, and that some of the steps described can be replaced or eliminated from the method 500.

At block 502, the BHA 170 measures downhole ΔP, such as using the downhole ΔP sensor 232 of the BHA 170.

At block 504, the BHA 170 measures downhole WOB and downhole TOB as the drill bit 175 is engaged with the bottom 173. For example, the downhole WOB sensor 245 may detect the downhole WOB and the downhole TOB sensor 242 may detect the downhole TOB.

At decision block 506, if the BHA 170 is configured to transmit relationship information to the surface control system 195 on a set periodic basis, then the method 500 proceeds to decision block 508.

At decision block 508, the BHA 170 determines whether the appropriate period of time has elapsed for a periodic transmission of the relationship to the surface. If not, then the BHA 170 buffers the collected information for the downhole ΔP, downhole WOB, and downhole TOB (e.g., in the memory 237 of FIG. 2) and the method 500 returns to block 502 and proceeds as laid out above and further below.

If at decision block 508 the BHA 170 instead determines that the appropriate period of time has elapsed (e.g., several minutes) then the method 500 proceeds from decision block 508 to block 510.

Returning to decision block 506, if the BHA 170 is instead configured to dynamically transmit relationship information based on threshold information, then the method 500 proceeds to block 510.

At block 510 (from either decision block 506 or decision block 508), the BHA 170 inputs the buffered downhole ΔP measurements and the buffered downhole WOB measurements into an algorithm. Further, the BHA 170 inputs the buffered downhole ΔP measurements and the buffered downhole TOB measurements into an algorithm (e.g., separate from the algorithm for WOB or shared therewith).

At block 512, the BHA 170 determines a relationship between the downhole ΔP measurements and the downhole WOB measurements. Further, the BHA 170 determines a relationship between the downhole ΔP measurements and the downhole TOB measurements. For example, the relationship may be determined using a time series regression for linear systems, a time series regression for non-linear systems, or a piece-wise linear table(s). The relationships may be in the form of one or more coefficients with respect to WOB and TOB separately (i.e., the downhole ΔP and downhole WOB relationship may have its own coefficients and the downhole ΔP and downhole TOB relationship its own coefficients).

At decision block 514, if the BHA 170 is configured to dynamically transmit relationship information based on threshold information, instead of set periods, then the method 500 proceeds to block 516.

At block 516, the BHA 170 compares the new coefficients determined from block 512 to the coefficients already sent to the surface control system 195 and currently implemented at the surface control system 195. For example, the BHA 170 may determine a difference value between the new coefficients and the coefficients currently implemented at the surface control system 195. Specifically, the BHA 170 may compare the new WOB coefficients from block 512 to the WOB coefficients implemented at the surface control system 195, and compare the new TOB coefficients to the TOB coefficients implemented at the surface control system 195.

At block 518, the BHA 170 compares the difference value determined at block 516 to a threshold value to determine whether to send the new coefficients from block 512 to the surface control system 195. For example, the threshold value may be a set value or a percentage value of the existing coefficients currently implemented at the surface control system 195. Specifically, the BHA 170 may compare the WOB difference value to a WOB threshold and the TOB difference value to a TOB threshold.

At decision block 520, if the WOB difference value does not exceed the WOB threshold, then the method 500 returns to block 502 and proceeds as laid out above and further below with respect to WOB measurements. Further, if the TOB difference value does not exceed the TOB threshold, then the method 500 returns to block 502 and proceeds as laid out above and further below with respect to TOB measurements.

If, however, it is determined at decision block 520 that the WOB threshold/TOB threshold is exceeded (using either or both as an example), then the method 500 proceeds to block 522.

At block 522, the BHA 170 transmits the new coefficients to the surface control system 195. For example, if the WOB threshold is exceeded, the BHA 170 transmits the new WOB coefficients determined from block 512 to the surface control system 195. If the TOB threshold is exceeded, then the BHA 170 transmits the new TOB coefficients determined from block 512 to the surface control system 195.

Returning to decision block 514, if the BHA 170 is not configured to dynamically transmit relationship information based on threshold information (e.g., the BHA 170 is set to a periodic basis for transmission and the time has elapsed), then the method 500 proceeds from decision block 514 to block 522 and proceeds as laid out above. From block 522, the method 500 may continue as laid out above from blocks 502 through 522 while drilling occurs. In some embodiments that may correspond to both vertical and directional drilling, while in other embodiments that may correspond to when kicking off a curve for directional drilling.

Figure 6:
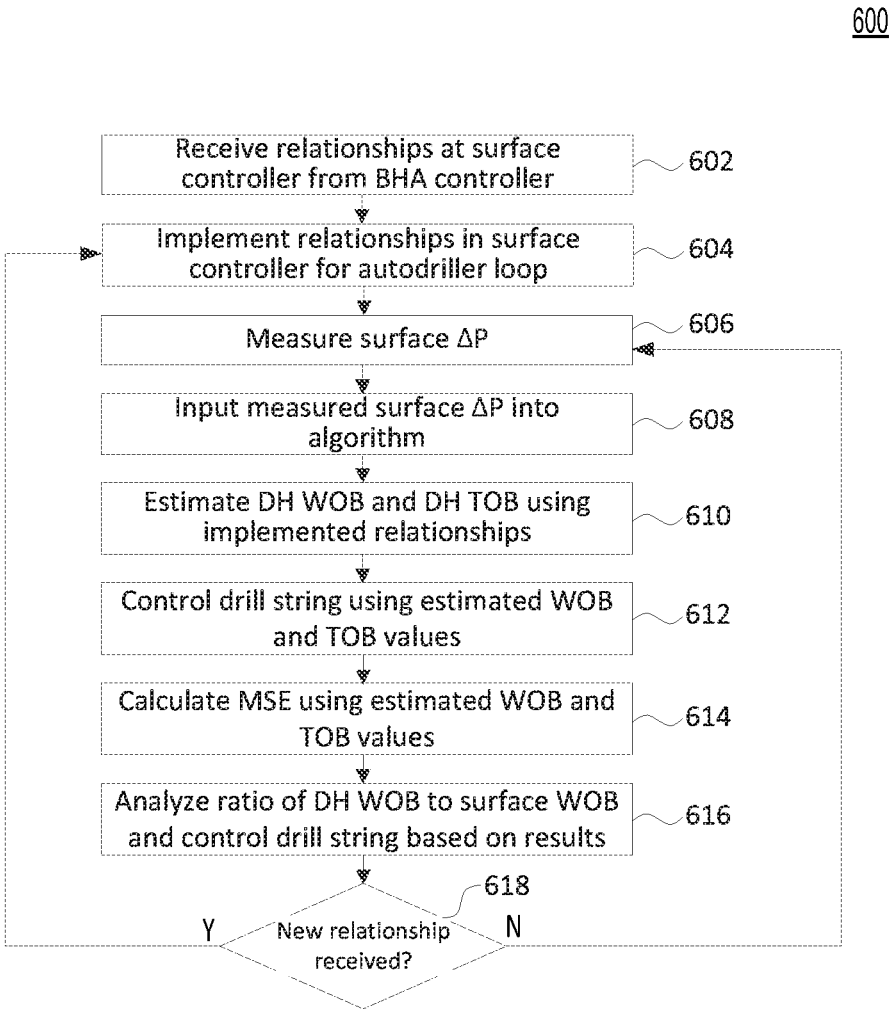
FIG. 6 is a flow chart showing an exemplary process for estimating downhole parameters for autodriller control according to aspects of the present disclosure.

FIG. 6 is a flow chart showing an exemplary process 600 for estimating downhole parameters for autodriller control according to aspects of the present disclosure. The method 600 may be performed, for example, with respect to the controller 210 of the surface control system 195 discussed above. It is understood that additional steps can be provided before, during, and after the steps of method 600, and that some of the steps described can be replaced or eliminated from the method 600.

At block 602, the controller 210 receives the relationship(s) (e.g., either or both of the downhole WOB and downhole TOB relationships to downhole ΔP coefficients) from the BHA 170.

At block 604, the controller 210 implements the coefficients for the relationships it receives, e.g. either or both of the downhole ΔP-WOB relationship and the downhole ΔP-TOB relationship, in respective formula (or aspects of a common formula).

At block 606, surface ΔP is measured by a surface ΔP sensor 280.

At block 608, the measured surface ΔP is input into the controller 210. Specifically, the measured surface ΔP is input into a formula for estimating the downhole WOB and another formula for estimating the downhole TOB (or a common formula).

At block 610, the controller 210 estimates the downhole WOB value using the surface ΔP value measured at block 606 and input at block 608. The controller 210 makes the estimation by inputting the measured surface ΔP into the formula for downhole WOB that has implemented the downhole ΔP-WOB relationship (i.e., the coefficients from the BHA 170). Further, the controller 210 estimates the downhole TOB value using the surface ΔP value measured at block 606 and input at block 608. The controller 210 makes the estimation by inputting the measured surface ΔP into the formula for downhole TOB that has implemented the downhole ΔP-TOB relationships (i.e., the coefficients from the BHA 170).

At block 612, the controller 210 controls the drill string 155 using the estimated downhole WOB and estimated downhole TOB as inputs into the autodriller feedback loop. Other inputs to the autodriller feedback loop may be included as well, such as drill string model information, measurements from other sensors such as flow and hook-load, etc.

At block 614, the controller 210 also uses the estimated downhole WOB and the estimated downhole TOB in calculating the MSE.

At block 616, the controller 210 analyzes the ratio between downhole WOB (whether estimated at block 610 or received from the BHA 170) and surface-determined WOB values (e.g., determined from hookload measurements from the hook load sensor 275) and controls the drill string 155 based on the results, such as discussed above with respect to FIG. 2 and block 416 of FIG. 4. For example, the analysis may include a comparison between the most recent ratio to one or more prior ratios. If the result of the comparison identifies a negative value for the change value between the two ratios, then this may cause the controller 210 to change (e.g., reduce or zero) the slack-off rate of the drill string 155 in the wellbore 160 to reduce or stop feeding the drill string 155 into the wellbore 160.

Other parameters may also be adjusted as part of the control, including for example oscillation speed, mud motor speed, and rate of penetration setpoint to name a few examples. Adjustment may alternate between adjusting the slack-off rate and the other parameters to improve the ratio to reach a zero or positive value again. Once the ratio reaches a zero or positive value again, the controller 210 may resume one or more of the changed drilling parameters to resume the weight transfer from the top drive 140 to the drill string 155.

At decision block 618, if new coefficients have been received from the BHA 170, then the method 600 returns to block 604, where the received coefficients are implemented for their formula (or formulas, if coefficients for both downhole WOB and downhole TOB formulas are received). The method 600 may then proceed from block 604 as laid out above.

If instead at decision block 618 new coefficients have not been received, then the method 600 returns to block 606 with obtaining surface ΔP measurements. The method 600 may then proceed from block 606 as laid out above.

Figure 7:
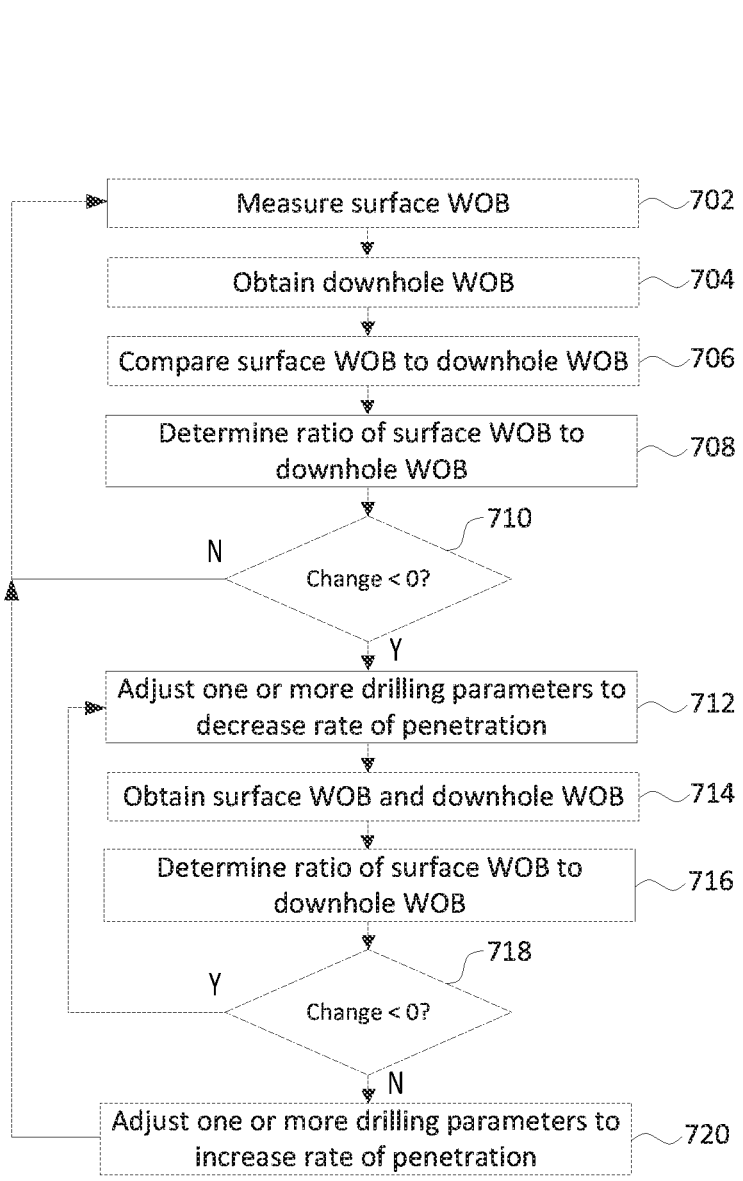
FIG. 7 is a flow chart showing an exemplary process for controlling weight transfer to bit according to aspects of the present disclosure.

Turning now to FIG. 7, a flow chart showing an exemplary process 700 for controlling weight transfer to bit according to aspects of the present disclosure is described. The method 700 may be performed, for example, with respect to the controller 210 of the surface control system 195 discussed above. It is understood that additional steps can be provided before, during, and after the steps of method 700, and that some of the steps described can be replaced or eliminated from the method 700.

At block 702, a surface ΔP value is measured by a surface ΔP sensor 280. The surface ΔP value is input into the controller 210.

At block 704, the controller 210 obtains a downhole WOB value. In some embodiments, the downhole WOB value may be an estimated value based on downhole ΔP-WOB coefficients from the BHA 170. In other embodiments, the downhole WOB value may be an actual value obtained from the downhole WOB sensor 245 and transmitted to the controller 210 at the surface.

Either way, at block 706 the controller 210 compares the surface-determined WOB to the downhole WOB value.

At block 708, the controller 210 continues the comparison by determining the ratio of the downhole WOB value to the surface-determined WOB. For example, the comparison may be between the most recent ratio to one or more prior ratios. As part of this comparison, the controller 210 may determine a change value that identifies a change between the current ratio and the one or more prior ratios (either the prior ratio or an average of some number of past ratios).

At decision block 710, if the change value is a zero or positive value, then the method 700 returns to block 702 and proceeds as laid out above and further below.

Instead, if at decision block 710 the change value is a negative value, then the method 700 proceeds to block 712.

At block 712, the controller 210 adjusts one or more drilling parameters to decrease the rate of penetration so as to reduce the energy being input into the drill string 155 that is not reaching the drill bit 175 yet. For example, the controller 210 may change (e.g., reduce or zero) the slack-off rate of the drill string 155 in the wellbore 160 to reduce or stop feeding the drill string 155 into the wellbore 160 until the change value for the newest ratios becomes zero or positive again.

As noted above, other parameters may also be adjusted as part of the control, including for example oscillation speed, mud motor speed, and rate of penetration setpoint to name a few examples. Adjustment may alternate between adjusting the slack-off rate and the other parameters to improve the ratio to reach a zero or positive value again.

At block 714, the controller 210 again obtains a downhole WOB value, either through estimation or receipt from BHA 170 as discussed above.

At block 716, the controller 210 again determines the ratio of the downhole WOB value to the surface-determined WOB as discussed above with respect to block 708, resulting in a new change value between the ratio and the old ratio.

At decision block 718, if the change value is still less than zero, a negative value, then the method 700 returns to block 712 to continue adjusting parameters in a loop until a zero or positive value is achieved.

If instead at decision block 718 the controller 210 determines that the change value is a zero or positive value again, then the method 700 continues to block 720.

At block 720, the controller 210 again adjusts one or more drilling parameters to increase the rate of penetration again, or in other words resume the weight transfer from the top drive 140 to the drill string 155 to add energy again to the drill string 155.

The method 700 may then return to block 702 and proceed as discussed above. In this manner, the controller 210 may operate to prevent sudden increases of actual downhole WOB, such as due to frictional forces at various sticking points along the wellbore 160 that cause drill pipe 165 to bend as the drill string 155 is lowered.

Accordingly, embodiments of the present disclosure provide improvements to autodriller control using determined relationships between downhole measurement data to estimate weight on bit and torque on bit using surface measurement data. Further, bit wear is improved as sudden increases of actual downhole WOB are prevented.

In view of the above and the figures, one of ordinary skill in the art will readily recognize that the present disclosure introduces a method comprising: measuring, by a bottom hole assembly (BHA), a downhole differential pressure at the BHA and a downhole weight on bit (WOB); determining, by a controller at the BHA, a relationship between the downhole differential pressure and the downhole WOB; and sending, from the BHA, the determined relationship to a surface controller for use in estimating WOB using a surface differential pressure measurement and the estimated WOB in an autodriller feedback loop.

The method may include wherein the determining the relationship further comprises inputting, by the controller, the downhole differential pressure and the downhole WOB versus time; and applying, by the controller, a time series regression to the input downhole differential pressure and the downhole WOB versus time to determine the relationship, wherein the determined relationship comprises a coefficient and the sending comprises sending the coefficient as the determined relationship. The method may also include wherein the time series regression comprises a linear relationship, and the surface controller implements the coefficient of a line equation or transfer function to estimate the downhole WOB based on the surface differential pressure measurement. The method may also include wherein the time series regression comprises a non-linear relationship, and the surface controller implements the coefficient in a polynomial or a piecewise linear table to estimate the downhole WOB based on the surface differential pressure measurement. The method may also include wherein the measuring is performed at a first period, the surface differential pressure measurement is obtained according to a second period, and the first period is greater than the second period. The method may also include determining, by the BHA, a difference between the determined relationship to a prior relationship between the downhole differential pressure and the downhole WOB; and comparing, by the BHA, the difference to a threshold value, wherein the sending further comprises sending the determined relationship in response to the difference being greater than the threshold value. The method may also include wherein the determined relationship comprises a first relationship, the method further comprising measuring, by the BHA, a downhole torque on bit (TOB); determining, by the BHA, a second relationship between the downhole differential pressure and the downhole TOB; and sending, from the BHA, the second relationship to the surface controller for use in estimating TOB using the surface differential pressure measurement and the estimated TOB in the autodriller feedback loop.

The present disclosure also includes an apparatus comprising a surface differential pressure sensor configured to sense a surface differential pressure; and a controller configured to implement, in an autodriller feedback loop, a coefficient representing a determined relationship between a downhole differential pressure and a downhole weight on bit (WOB) received from a bottom hole assembly (BHA); input the surface differential pressure from the surface differential pressure sensor into the autodriller feedback loop implementing the coefficient; estimate a WOB based on the surface differential pressure input into the autodriller feedback loop; and control a drill string based on the estimated WOB in the autodriller feedback loop.

The apparatus may include wherein the coefficient is determined from a time series regression of the downhole differential pressure and the downhole WOB versus time. The apparatus may also include wherein the time series regression comprises a linear relationship. The apparatus may also include wherein the controller is configured to receive the coefficient from the BHA in response to a difference between the coefficient and a prior coefficient being greater than a threshold value. The apparatus may also include wherein the controller is further configured to estimate a mechanical specific energy (MSE) based on the surface differential pressure input into the autodriller feedback loop or displayed to a user. The apparatus may also include wherein the controller is further configured to determine a ratio between the estimated WOB and a surface WOB; and adjust a slack-off rate to decrease a rate of penetration for the drill string in response to a change of the ratio assuming a negative value. The apparatus may also include wherein the controller is further configured to repeatedly determine the ratio between the estimated WOB and the surface WOB with corresponding change value; and adjust the slack-off rate to increase the rate of penetration for the drill string in response to the change of the ratio reaching a zero or positive value.

The present disclosure also includes a non-transitory machine-readable medium having stored thereon machine-readable instructions executable to cause a machine to perform operations comprising determining a ratio between a surface weight on bit (WOB) of a drill string, applied in response to a set rate of penetration (ROP), and a downhole WOB; determining a change value of the ratio; and adjusting the set ROP in response to the change value of the ratio becoming a negative value until the change value of the ratio reaches a zero or positive value.

The non-transitory machine-readable medium also includes operations further comprising adjusting an oscillation speed in response to the change value of the ratio becoming the negative value. The non-transitory machine-readable medium may also include operations further comprising receiving, at the machine, the downhole WOB in real time from a WOB sensor at a bottom hole assembly (BHA) of the drill string via a wired pipe. The non-transitory machine-readable medium may also include operations further comprising implementing, in an autodriller feedback loop, a coefficient representing a determined relationship between a downhole differential pressure and the downhole WOB received from a bottom hole assembly (BHA); inputting a surface differential pressure from a surface differential pressure sensor into the autodriller feedback loop implementing the coefficient; and estimating the surface WOB based on the surface differential pressure input into the autodriller feedback loop. The non-transitory machine-read-able medium may also include operations further comprising receiving the coefficient from the BHA in response to a difference between the coefficient and a prior coefficient being greater than a threshold value. The non-transitory machine-readable medium may also include operations further comprising determining a plurality of ratios over time in response to a plurality of surface WOB and downhole WOB values received over the time; and identifying a trend over the time that represents an efficiency of a bit at a bottom hole assembly (BHA) of the drill string.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method, comprising:

measuring, by a bottom hole assembly (BHA), a downhole differential pressure at the BHA and a downhole weight on bit (WOB);

determining, by a controller at the BHA, a relationship between the downhole differential pressure and the downhole WOB, wherein the determined relationship comprises a coefficient;

determining, by the controller at the BHA, a difference between the coefficient and a prior coefficient, wherein the prior coefficient comprises a relationship between a prior downhole differential pressure and a prior downhole WOB;

comparing, by the controller at the BHA, the difference to a threshold value; and sending, from the BHA in response to the difference being greater than the threshold value, the coefficient to a surface controller for use in estimating WOB using a surface differential pressure measurement in an autodriller feedback loop.

2. The method of claim 1, wherein the determining the relationship further comprises:

inputting, by the controller, the downhole differential pressure and the downhole WOB versus time; and applying, by the controller, a time series regression to the input downhole differential pressure and the downhole WOB versus time to determine the relationship.

3. The method of claim 2, wherein:

the time series regression comprises a linear relationship, and the surface controller implements the coefficient of a line equation or transfer function to estimate the downhole WOB based on the surface differential pressure measurement.

4. The method of claim 2, wherein:

the time series regression comprises a non-linear relationship, and the surface controller implements the coefficient in a polynomial or a piecewise linear table to estimate the downhole WOB based on the surface differential pressure measurement.

5. The method of claim 1, wherein:

the measuring is performed at a first period, the surface differential pressure measurement is obtained according to a second period, and the first period is greater than the second period.

6. The method of claim 1, wherein the determined relationship comprises a first relationship, the method further comprising:

measuring, by the BHA, a downhole torque on bit (TOB);

determining, by the BHA, a second relationship between the downhole differential pressure and the downhole TOB; and sending, from the BHA, the second relationship to the surface controller for use in estimating TOB using the surface differential pressure measurement and the estimated TOB in the autodriller feedback loop.

7. An apparatus, comprising:

a surface differential pressure sensor configured to sense a surface differential pressure; and a controller configured to:

receive, from a bottom hole assembly (BHA), a coefficient representing a determined relationship between a downhole differential pressure and a downhole weight on bit (WOB), the coefficient being received in response to a difference between the coefficient and a prior coefficient being greater than a threshold value, the prior coefficient comprising a relationship between a prior downhole differential pressure and a prior downhole WOB;

implement, in an autodriller feedback loop, the coefficient;

input the surface differential pressure from the surface differential pressure sensor into the autodriller feedback loop implementing the coefficient;

estimate a WOB based on the surface differential pressure input into the autodriller feedback loop; and control a drill string based on the estimated WOB in the autodriller feedback loop.

8. The apparatus of claim 7, wherein the coefficient is determined from a time series regression of the downhole differential pressure and the downhole WOB versus time.

9. The apparatus of claim 8, wherein the time series regression comprises a linear relationship.

10. The apparatus of claim 7, wherein the controller is further configured to:

estimate a mechanical specific energy (MSE) based on the surface differential pressure input into the autodriller feedback loop.

11. The apparatus of claim 7, wherein the controller is further configured to:

determine a ratio between the estimated WOB and a surface WOB; and adjust a slack-off rate to decrease a rate of penetration for the drill string in response to a change of the ratio assuming a negative value.

12. The apparatus of claim 11, wherein the controller is further configured to:

repeatedly determine the ratio between the estimated WOB and the surface WOB with corresponding change value; and adjust the slack-off rate to increase the rate of penetration for the drill string in response to the change of the ratio reaching a zero or positive value.

13. A non-transitory machine-readable medium having stored thereon machine-readable instructions executable to cause a machine to perform operations comprising:

receiving, from a bottom hole assembly (BHA), a coefficient representing a determined relationship between a downhole differential pressure and a downhole weight on bit (WOB), the coefficient being received in response to a difference between the coefficient and a prior coefficient being greater than a threshold value, the prior coefficient representing a relationship between a prior downhole differential pressure and a prior downhole WOB;

estimating a surface WOB based on a surface differential pressure input into an autodriller feedback loop implementing the coefficient;

determining a ratio between the surface WOB of a drill string, applied in response to a set rate of penetration (ROP), and the downhole WOB;

determining a change value of the ratio; and adjusting the set ROP in response to the change value of the ratio becoming a negative value until the change value of the ratio reaches a zero or positive value.

14. The non-transitory machine-readable medium of claim 13, the operations further comprising:

adjusting an oscillation speed in response to the change value of the ratio becoming the negative value.

15. The non-transitory machine-readable medium of claim 13, the operations further comprising:

receiving, at the machine, the downhole WOB in real time from a WOB sensor at the BHA of the drill string via a wired pipe.

16. The non-transitory machine-readable medium of claim 13, the operations further comprising:

inputting a surface differential pressure from a surface differential pressure sensor into the autodriller feedback loop implementing the coefficient.

17. The non-transitory machine-readable medium of claim 13, the operations further comprising:

determining a plurality of ratios over time in response to a plurality of surface WOB and downhole WOB values received over the time; and identifying a trend over the time that represents an efficiency of a bit at the BHA of the drill string.

18. The method of claim 1, wherein the threshold value is a percentage of the coefficient and the prior coefficient.

19. The apparatus of claim 7, wherein the controller is further configured to adjust a rate of penetration for the drill string based on a target WOB.

20. The non-transitory machine-readable medium of claim 13, wherein the threshold value is a percentage of the coefficient and the prior coefficient.

* * * * *